US010935223B2

(12) United States Patent
Gall et al.

(10) Patent No.: US 10,935,223 B2
(45) Date of Patent: Mar. 2, 2021

(54) FOLDING FLOOD LIGHTING DEVICE

(71) Applicant: MILWAUKEE ELECTRIC TOOL CORPORATION, Brookfield, WI (US)

(72) Inventors: Benjamin D. Gall, Milwaukee, WI (US); David Proeber, Milwaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 5 days.

(21) Appl. No.: 16/357,978

(22) Filed: Mar. 19, 2019

(65) Prior Publication Data

US 2019/0285257 A1 Sep. 19, 2019

Related U.S. Application Data

(60) Provisional application No. 62/644,642, filed on Mar. 19, 2018.

(51) Int. Cl.

| | |
|---|---|
| ***F21V 21/30*** | (2006.01) |
| ***F21L 4/00*** | (2006.01) |
| ***F21S 9/02*** | (2006.01) |
| ***F21V 21/40*** | (2006.01) |
| ***F21V 21/14*** | (2006.01) |
| *F21W 131/10* | (2006.01) |

(Continued)

(52) U.S. Cl.

CPC ..... *F21V 21/30* (2013.01); *F21L 4/00* (2013.01); *F21S 9/02* (2013.01); *F21V 21/145* (2013.01); *F21V 21/406* (2013.01); *F21W 2131/10* (2013.01); *F21W 2131/402* (2013.01); *F21Y 2105/10* (2016.08); *F21Y 2115/10* (2016.08)

(58) Field of Classification Search

CPC ..... F21V 21/30; F21Y 2115/10; F21S 9/02; F21L 4/00

See application file for complete search history.

(56) References Cited

U.S. PATENT DOCUMENTS

| | | | |
|---|---|---|---|
| 4,938,440 | A | 7/1990 | Weinfield |
| 5,205,645 | A | 4/1993 | Lee |

(Continued)

FOREIGN PATENT DOCUMENTS

| | | |
|---|---|---|
| CN | 201166273 | 12/2008 |
| CN | 201824664 | 5/2011 |

(Continued)

OTHER PUBLICATIONS

International Search Report and Written Opinion for Related Application No. PCT/US2019/022923 dated Jul. 31, 2019 (21 pages).

(Continued)

*Primary Examiner* — Joseph L Williams

(74) *Attorney, Agent, or Firm* — Michael Best & Friedrich LLP

(57) ABSTRACT

A lighting device includes a light housing, a light source coupled to the light housing, and a battery compartment coupled to the light housing and configured to house a battery. The battery compartment defines a central longitudinal axis along which the battery is insertable. The lighting device additionally includes a base coupled to the light housing. The light housing and the battery compartment are rotatable together relative to the base about the central longitudinal axis.

19 Claims, 7 Drawing Sheets

(51) Int. Cl.

| | |
|---|---|
| *F21Y 115/10* | (2016.01) |
| *F21Y 105/10* | (2016.01) |
| *F21W 131/402* | (2006.01) |

(56) References Cited

U.S. PATENT DOCUMENTS

| | | | |
|---|---|---|---|
| 6,354,720 | B2 | 3/2002 | Grossman et al. |
| 6,986,590 | B1 | 1/2006 | Padden |
| 7,021,789 | B2 | 4/2006 | Dalton et al. |
| 7,121,688 | B2 | 10/2006 | Rempel |
| D558,369 | S | 12/2007 | O'Hern |
| D588,733 | S | 3/2009 | O'Hern |
| 7,524,081 | B2 | 4/2009 | Dalton et al. |
| D593,236 | S | 5/2009 | Ng et al. |
| 7,618,153 | B2 | 11/2009 | O'Hern |
| 7,621,652 | B2 | 11/2009 | Zick |
| RE41,795 | E | 10/2010 | Dalton et al. |
| 7,850,331 | B2 | 12/2010 | Dalton et al. |
| D636,915 | S | 4/2011 | Bryant et al. |
| 7,918,585 | B2 | 4/2011 | Tucker |
| D638,153 | S | 5/2011 | Christ et al. |
| 7,954,980 | B2 | 6/2011 | Bryant et al. |
| 8,025,418 | B2 | 9/2011 | Zick |
| 8,215,792 | B2 | 7/2012 | Dalton et al. |
| 8,430,529 | B2 | 4/2013 | Christ et al. |
| D700,382 | S | 2/2014 | Christ et al. |
| 8,721,120 | B2 | 5/2014 | Christ et al. |
| 9,046,231 | B2 | 6/2015 | Christ et al. |
| D763,492 | S | 8/2016 | Bryant et al. |
| 9,482,395 | B2 | 11/2016 | Ellingson et al. |
| 10,072,829 | B1 | 9/2018 | Christ et al. |
| D844,866 | S | 4/2019 | Christ et al. |
| D858,832 | S | 9/2019 | Dorman |
| D870,954 | S | 12/2019 | Gall |
| 2005/0007769 | A1 | 1/2005 | Bonzer et al. |
| 2006/0077670 | A1 | 4/2006 | Yuen |
| 2010/0238653 | A1 | 9/2010 | Pelletier et al. |
| 2010/0277096 | A1 | 11/2010 | Kim |
| 2011/0075405 | A1 | 3/2011 | Dalton et al. |
| 2011/0299275 | A1 | 12/2011 | Fuchs et al. |
| 2012/0182748 | A1* | 7/2012 | McCaslin ..... B62J 6/02 362/473 |
| 2014/0126192 | A1 | 5/2014 | Ancona et al. |
| 2014/0334155 | A1 | 11/2014 | Christ et al. |
| 2017/0108197 | A1 | 4/2017 | Cacciabeve |
| 2017/0130912 | A1 | 5/2017 | Keller |
| 2017/0159897 | A1 | 6/2017 | Paetz et al. |

FOREIGN PATENT DOCUMENTS

| | | |
|---|---|---|
| CN | 201827664 | 5/2011 |
| CN | 102401239 | 4/2012 |
| CN | 102661490 | 9/2012 |
| CN | 202691617 | 1/2013 |
| CN | 203273320 | 11/2013 |
| CN | 203375402 | 1/2014 |
| CN | 204387915 | 6/2015 |
| CN | 104964199 | 10/2015 |
| CN | 204693058 | 10/2015 |
| CN | 204693172 | 10/2015 |
| CN | 204693173 | 10/2015 |
| CN | 206207282 | 5/2017 |
| CN | 206478580 | 9/2017 |
| CN | 206682895 | 11/2017 |
| DE | 9303588 | 7/1993 |
| DE | 102013208907 | 11/2014 |
| DE | 102014204971 | 11/2014 |
| DE | 102015222433 | 5/2017 |
| EP | 2998444 | 3/2016 |
| WO | 2011024643 | 3/2011 |

OTHER PUBLICATIONS

Invitation to Pay Additional Fees and Partial Search Report for Application No. PCT/US2019/022923, dated Jun. 4, 2019, 16 pages.

* cited by examiner

FOLDING FLOOD LIGHTING DEVICE

CROSS-REFERENCE TO RELATED APPLICATIONS

This application claims priority to U.S. Provisional Patent Application No. 62/644,642, filed on Mar. 19, 2018, the entire contents of which are incorporated by reference herein.

FIELD OF THE INVENTION

The present invention relates to portable lights and, more particularly, to folding flood lights.

SUMMARY

In one aspect, the invention provides a lighting device including a light housing, a light source coupled to the light housing, and a battery compartment coupled to the light housing and configured to house a battery. The battery compartment defines a central longitudinal axis along which the battery is insertable. The lighting device also includes a base coupled to the light housing. The light housing and the battery compartment are rotatable together relative to the base about the central longitudinal axis.

In another aspect, the invention provides a lighting device including a light housing having a first face and a second face opposite the first face, a light source coupled to the light housing and configured to emit light from the first face, and a base rotatably coupled to the light housing. The base includes a first side and a second side opposite the first side. The first side is configured to rest on a support surface to support the lighting device. The light housing is rotatable relative to the base from a first position, where the second face of the light housing is adjacent the second side of the base, to a second position, where the first face of the light housing is offset and coplanar with the first side of the base.

In another aspect, the invention provides a lighting device including a light housing, a light source coupled to the light housing, and a base rotatably coupled to the light housing. The base is configured to support the light housing on a support surface at a plurality of angles. The base includes a carabineer having a first arm extending from the light housing, a second arm extending from the light housing and spaced apart from the first arm, and a gate extending between the first arm and the second arm.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-6E illustrate a lighting device 10 according to one embodiment of the invention. The lighting device 10 includes a flood light configured to illuminate an area and may be referred to as a flood lighting device. More particularly, the foldable between different configurations and may be referred to as a folding flood lighting device. The illustrated lighting device 10 includes a light housing 14 rotatable relative to a base 18. The lighting device 10 is moveable between a collapsed position and multiple extended positions. When in the collapsed position (FIG. 6A), the lighting device 10 is relatively compact for storage and transport. When in one of the extended positions (FIGS. 6B-6E), the light housing 14 is pivoted, redirecting the direction of light emitted from the housing 14.

Figure 5A:
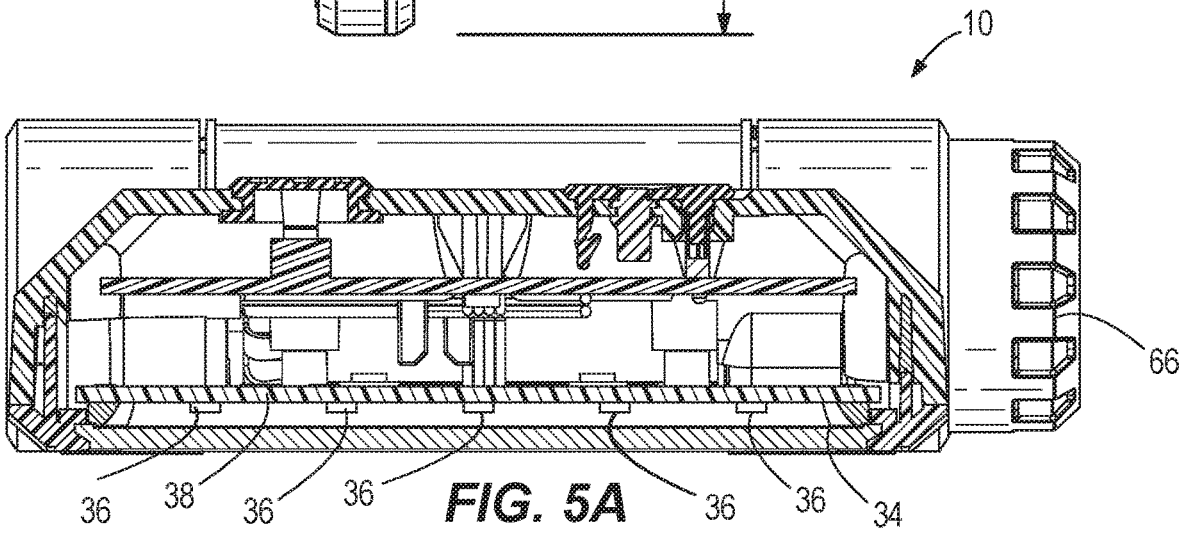
FIG. 5A is a side cross-sectional view of the lighting device taken along section line 5A-5A of FIG. 1.
Figure 5C:
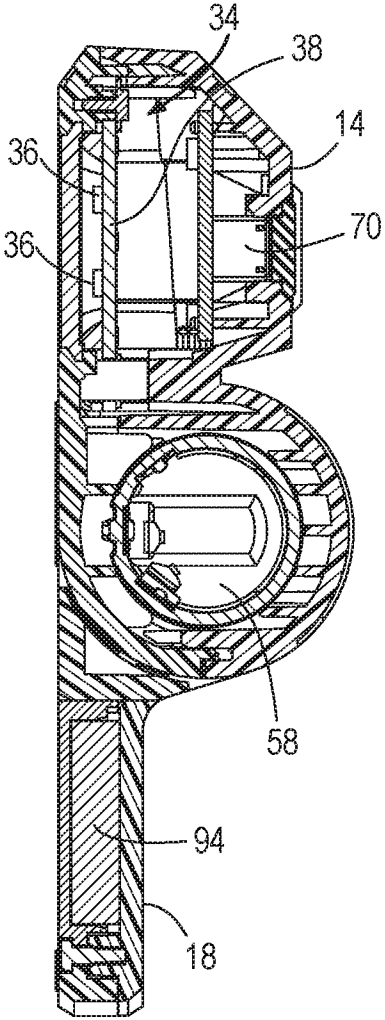
FIG. 5C is a front cross-sectional view of the lighting device taken along section line 5C-5C of FIG. 1.

The illustrated light housing 14 includes a generally rectangular housing having a first face 22 (FIG. 3) and a second face 26 (FIGS. 1-2) opposite the first face 22. The first face 22 has a beveled surface that supports a lens 30 and a light source 34 (FIG. 5C). The lens 30 is supported by and extends from the light housing 14. The lens 30 surrounds and encloses the light source 34 to help protect the light source 34. The lens 30 also diffuses light emitted from the light source 34 to the surrounding area, in a direction away from the base 18. The light source 34 is positioned behind the lens 30. In the illustrated embodiment, the light source 34 includes one or more light emitting diodes (LEDs) 36 and a thermal clad insulated metal substrate 38 (T-clad) positioned behind the light source 34 (FIG. 5C). In other embodiments, other suitable light sources may also or alternatively be employed. In still further embodiments, the light device 10 may include a heat sink rather than the T-clad 38. The light source 34 is controlled via a control panel 42 on the second face 26 of the light housing 14 to operate the light device 10.

The lighting device 10 is configured to emit light via the light source 34 in a specific direction. The control panel 42 is electrically connected to the light source 34 to control the light device 10; for example, to turn the light device 10 on and off using a power actuator 46. The actuator 46 could be a button, switch, or any suitable control mechanism that is configured to control the light. In the illustrated embodiments, the actuator 46 operates the light device 10 in three modes: a high mode where the light source 34 is operable to emit light having an intensity of at least 500 lumens, a medium mode where the light source 34 is operable to emit light having an intensity of at least 250 lumens, and a low mode where the light source is operable to emit light having an intensity of at least 80 lumens. In the illustrated embodiment, the light source 34 emits light at approximately 600 lumens while in the high mode, at approximately 280 lumens while in the medium mode, and at approximately 90 lumens while in the low mode. Additionally, the control panel 42 includes a charging port 50. The illustrated charging port 50 includes a USB port, although other suitable charging ports may also or alternatively be included on the light device 10.

The lighting device 10 also includes a battery compartment 54 coupled to the light housing 14. In the illustrated embodiment, the battery compartment 54 is generally cylindrical. The battery compartment 54 is configured to hold a DC power source (e.g., a battery 58 (FIG. 5B-5C)). The battery 58 is insertable into and removable from a receiving port 62 formed within the battery compartment 54. Specifically, the battery 58 is insertable into and removable from the receiving port 62 along a central longitudinal axis 60, which is defined by the battery compartment 54. A removable battery cover 66 helps to retain the battery 58 within the receiving port 62 to inhibit unwanted removal of the battery 58, and allows the light device 10 to be replaced and/or recharged. The battery 58 is also rechargeable via the charging port 50 without removing the battery 58 from the battery compartment 54. Circuitry of the lighting device 10 is designed so the battery 58 has a sufficient voltage to power the light source 34 for an extended period of time. For example, the battery 58 can power the light source 34 in the high mode for at least two hours, can power the light source 34 in the medium mode for at least four hours, and can power the light source 34 in the low mode for at least ten hours. In some embodiments, the battery 58 may have a Li-ion chemistry such that the battery 58 is also relatively lightweight (e.g., about 55 grams). In other embodiments, the battery 58 may have other chemistries, such as an alkaline chemistry.

Figure 5B:
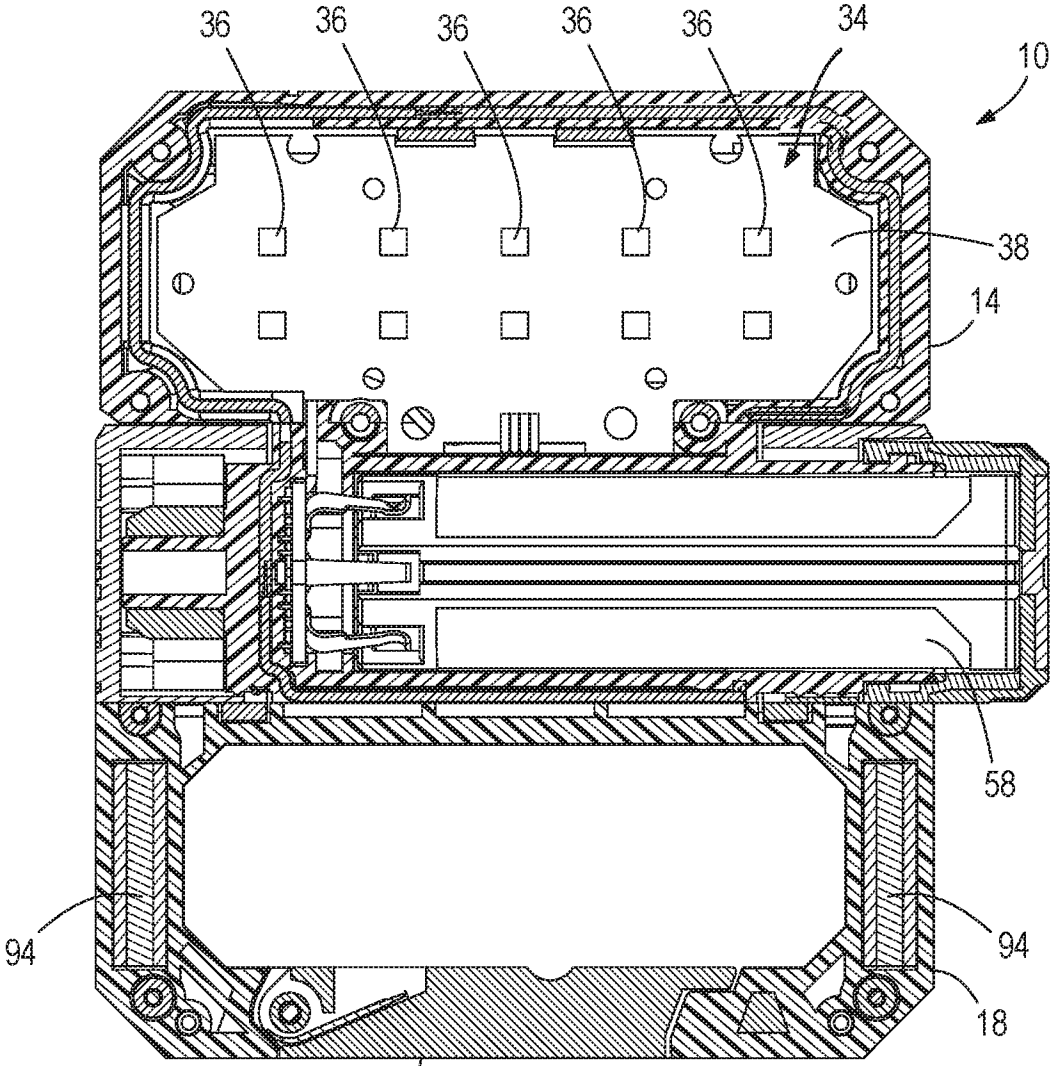
FIG. 5B is a side cross-sectional view of the lighting device take along section line 5B-5B of FIG. 1.

As shown in FIG. 5B, the lighting device 10 also includes an internal control unit 70, such as a microcontroller or memory unit, for storing information and executable functions. The internal control unit 70 is configured to store the state of the light device 10 as set by the actuator 46 when the light device 10 is powered ON and OFF by the actuator 46. This results in a light that may be turned ON and OFF while maintaining the most recent state of the light (e.g., the mode of the light), thereby allowing the user to turn the light 10 on with the last setting without having to readjust the light. In other embodiments, the light source 34 may cycle through the modes (e.g., high, medium, low, off) by repeatedly pressing the power actuator 46.

Figure 1:
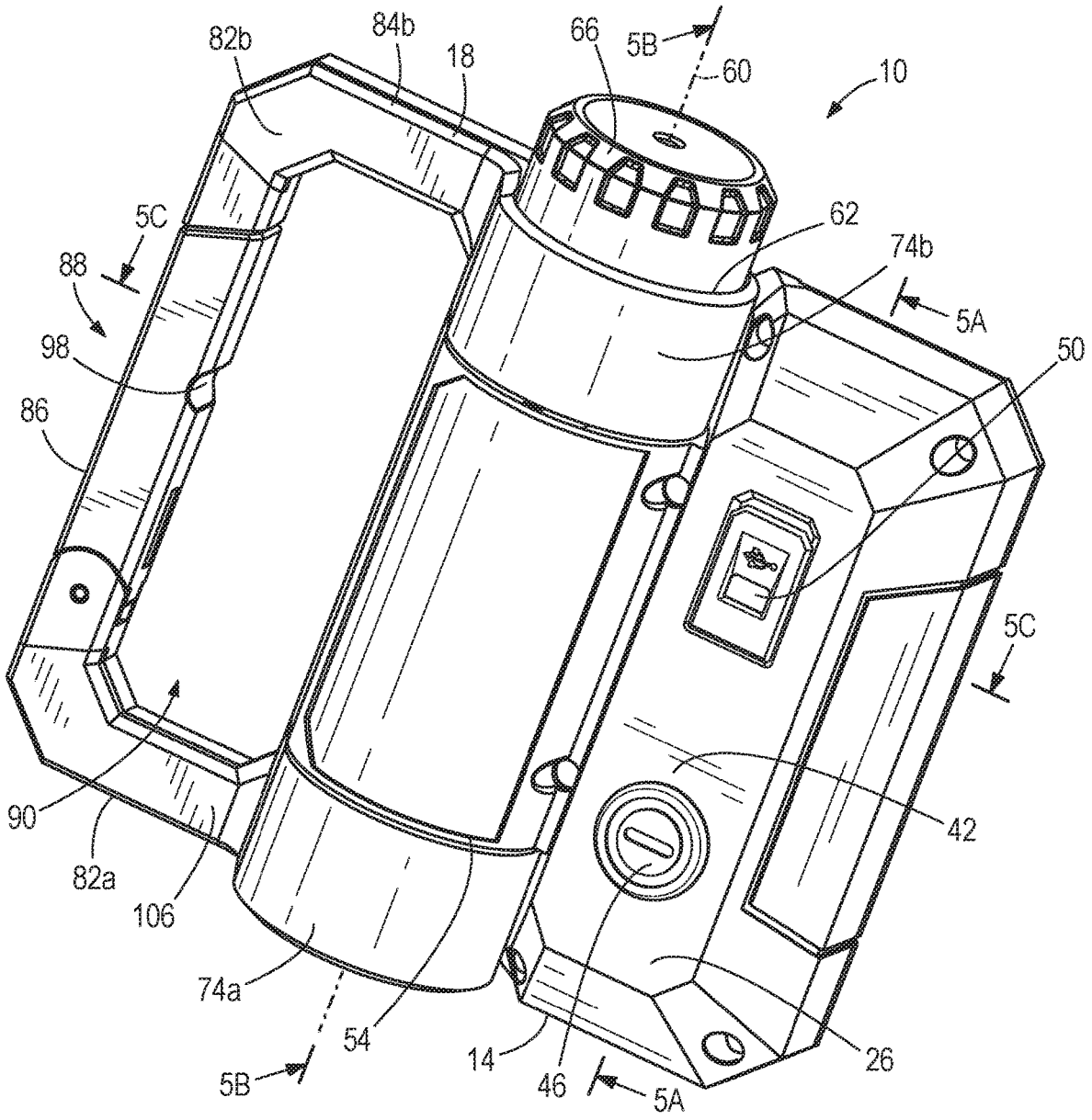
FIG. 1 is a perspective view of a lighting device.
Figure 2:
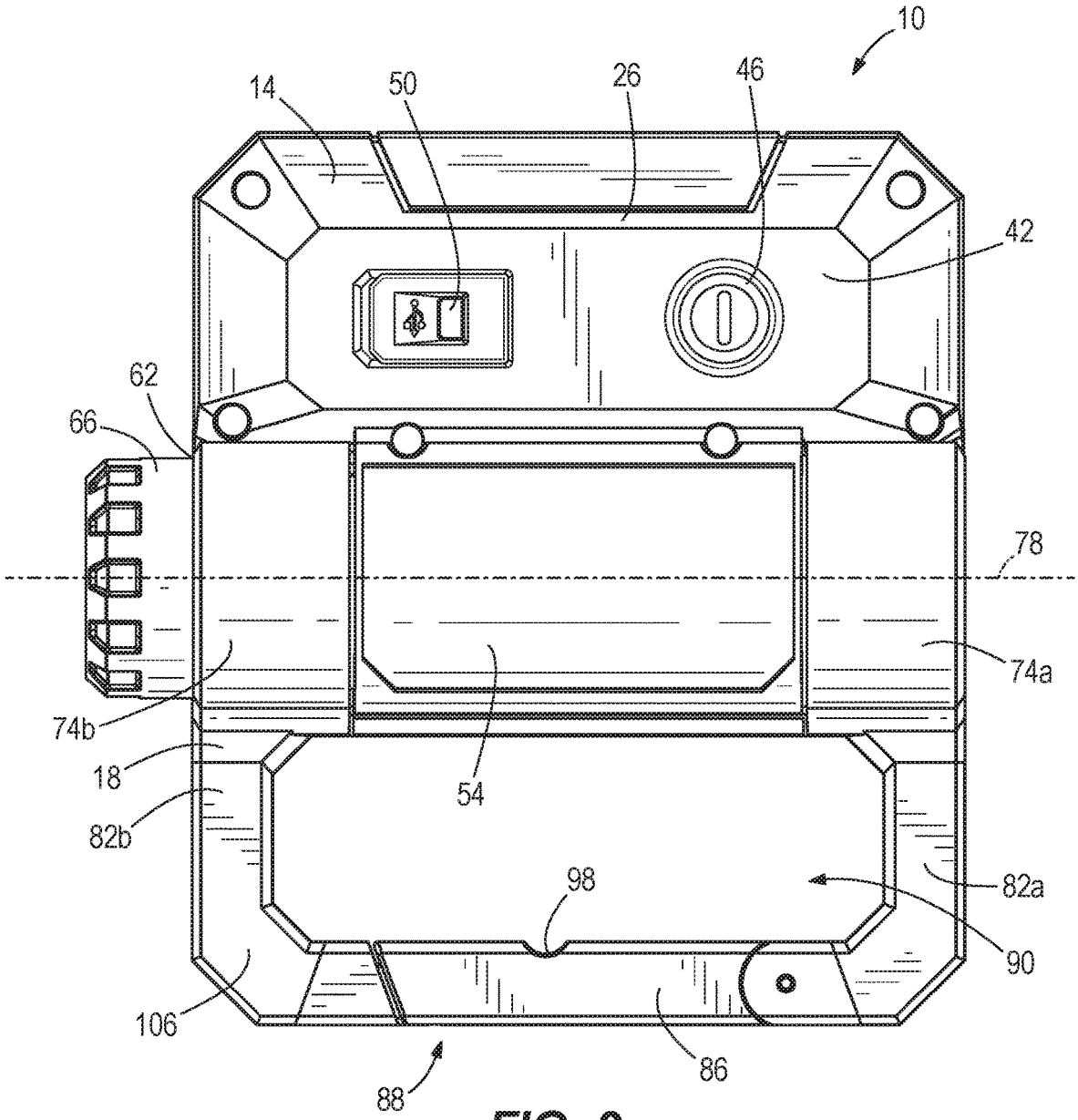
FIG. 2 is a back view of the lighting device of FIG. 1.
Figure 3:
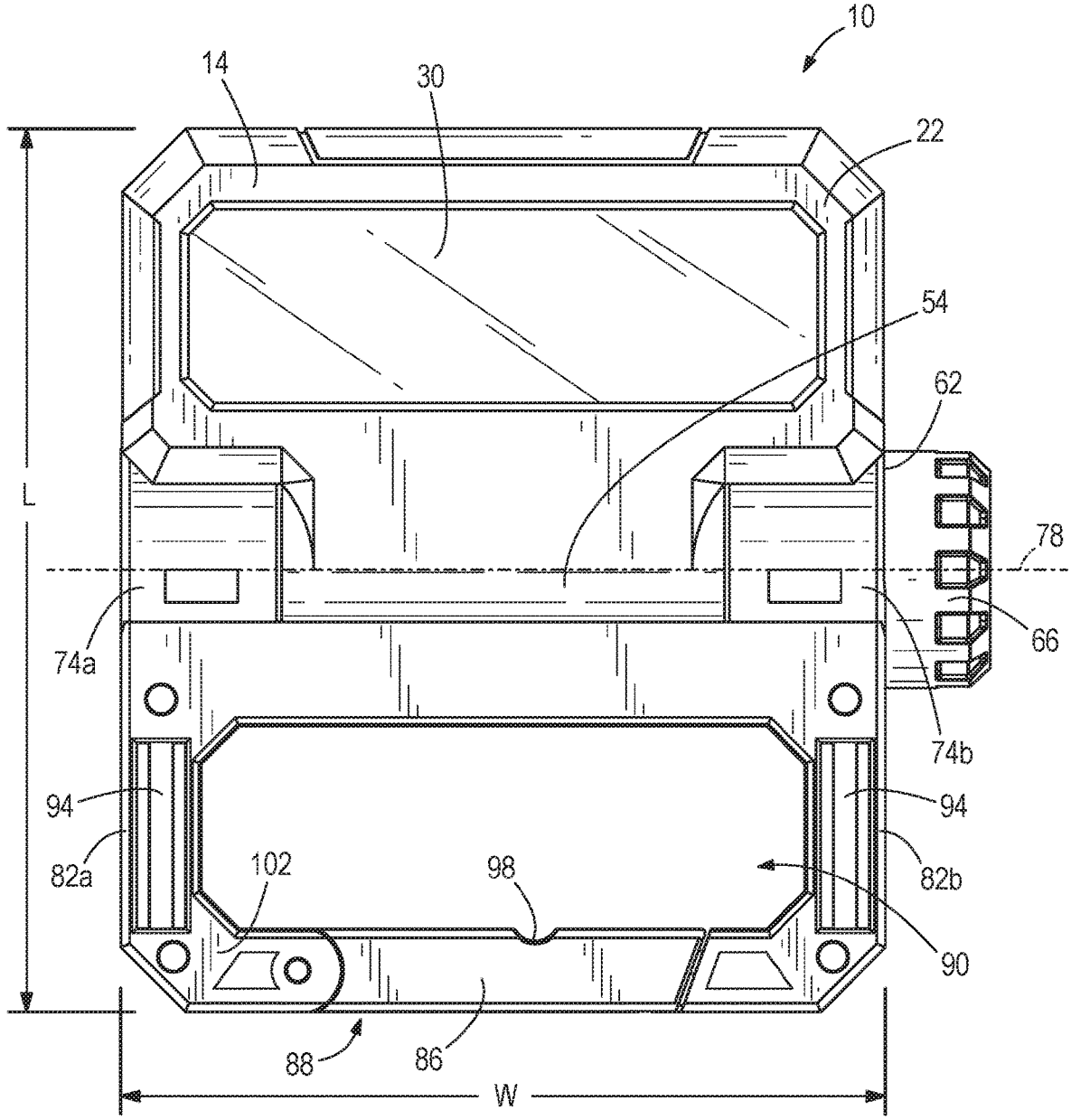
FIG. 3 is front view of the lighting device of FIG. 1.
Figure 4:
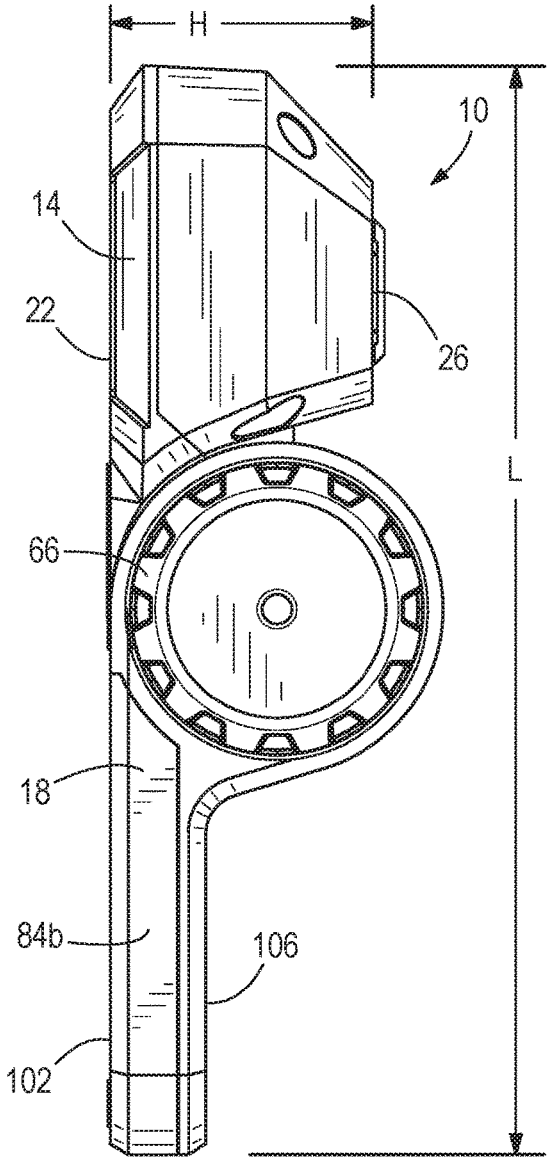
FIG. 4 is a side view of the lighting device of FIG. 1.

As shown in FIGS. 1-3, the base 18 is rotatably coupled to the light housing 14. The base 18 includes a first boss 74*a* and a second boss 74*b* surrounding and enclosing a first end 54*a* and a second end 54*b* of the battery compartment 54, allowing the housing 54 to rotate relative about a pivot axis 78 relative to the base 18. The pivot axis 78 is parallel to (and, more particularly, collinear with) the central longitudinal axis 60 of the battery compartment 54. The base 18 also has a first side 102 and a second side 106 opposite the first side 102. The first side 102 is configured to rest on a support surface (e.g., a table, a floor, a bench, etc.) to support the lighting device 10 on the support surface.

The illustrated base 18 further includes a carabineer 88. Specifically, the carabineer 88 includes a first arm 82*a* and a second arm 82*b* extending from the bosses 74*a*, 74*b*. The arms 82*a*, 82*b* are spaced apart from each other. In the illustrated embodiment, the arms 82*a*, 82*b* are also generally parallel to each other, but may alternatively be angled relative to each other. Ends of the arms 82*a*, 82*b* are angled inwards approximately 90 degrees relative to each other. The first and second arms 82*a*, 82*b* additionally include first and second edges 84*a*, 84*b*, respectively. The edges 84*a*, 84*b* are positioned on outer surfaces of the arms 82*a*, 82*b* and are substantially parallel to each other. More specifically, the first and second edges 84*a*, 84*b* are oriented substantially normal to the first and second sides 102, 106. In some embodiments, the user may position the base 18 such that the first edge 84*a* or the second edge 84*b* rests on a support surface to support the lighting device 10. The carabineer 88 also includes a gate 86 connecting the arms 82*a*, 82*b*. An aperture 90 is defined between the arms 82*a*, 82*b* and the gate 86, allowing the base 18 to function as a handle for the user. The gate 86 is pivotable relative to the arms 82*a*, 82*b* to provide selective access to the aperture 90 such that the light device 10 can be hung from or clipped to another object (e.g., a belt loop, a wall hook, etc.).

In some embodiments, the gate 86 may be composed of a metal material. Additionally or alternatively, as shown in FIG. 3, the arms 82*a*, 82*b* may include internal magnetic plates 94. The metal material of the gate 86 and the magnetic plates 94 of the arms 82*a*, 82*b* allow the base 18 to be magnetically coupled to other metal surfaces during use. For example, the base 18 can be hung from a vertical or semi-vertical metallic surface, or the base 18 can be secured to a horizontal metallic surface to inhibit the light device 10 from being accidentally moved.

The gate 86 further includes a detent 98, allowing the carabineer 88 to operate as a hanging hook. The illustrated detent 98 is a small recess formed on an inner surface of the gate 86 (i.e., the surface facing inward toward the aperture 90). The detent 98 allows the light device 10 to be hung on a non-metal (e.g., wood) support structure (e.g., a hook, rod, etc.) to hang the light device 10 above a support surface. In the shown embodiments, the flood light 10 weighs approximately 235 grams, including the weight of the battery 58. However, in other embodiments, the lighting device 10 may weigh less than 175 grams (without the battery 58).

As shown in FIGS. 6A-6E, the light housing 14 and the battery compartment 54, including the battery 58, are rotatable together relative to the base 18 about the pivot axis 78 from a collapsed position (FIG. 6A) to multiple extended positions (FIGS. 6B-6E). In the illustrated embodiment, the light housing 14 is movable relative to the base 18 through an angle of 210 degrees, allowing the user to redirect the lens 30 and the light source 34 from approximately 0 to 210 degrees.

For example, when the light housing 14 is in the collapsed position (FIG. 6A) such that the light housing 14 overlaps (i.e., is stacked on), but faces away from the base 18, the light housing 14 is in a 0 degree position. In the collapsed position, the second face 26 of the light housing 14 is in contact with a second face, or side, 106 of the base 18, while a first face, or side, 102 of the base 18 and the first face 22 of the light housing 14 face away from each other, but are substantially parallel. In this position, the light source 34 is configured to emit light in a direction away from the base 18.

When the light housing 14 is in a fully extended position (FIG. 6D) such that the first face 22 of the light housing 14 is offset from, but inline and coplanar with the base 18, the light housing 14 is in a 180 degree position.

When the light housing 14 is in an overextended position (FIG. 6E), the light housing 14 is extended past the fully extended position, and the front face 22 of the light housing 14 is oriented approximately 210 degrees relative to the second side 106 of the base 18.

Figure 6A:
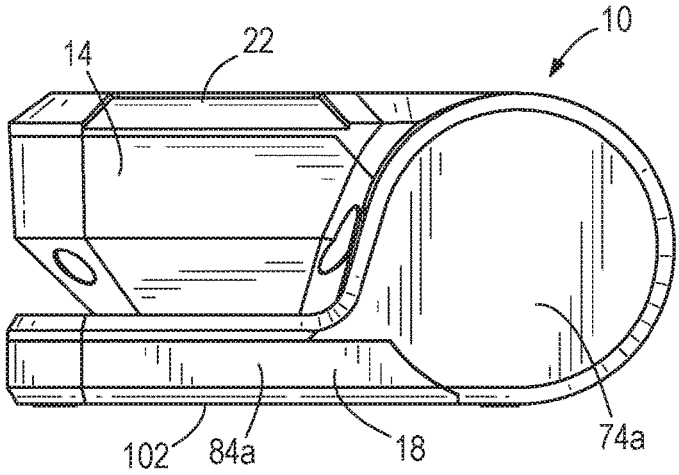
FIG. 6A is a side view of the lighting device of FIG. 1 in a collapsed position.
Figure 6B:
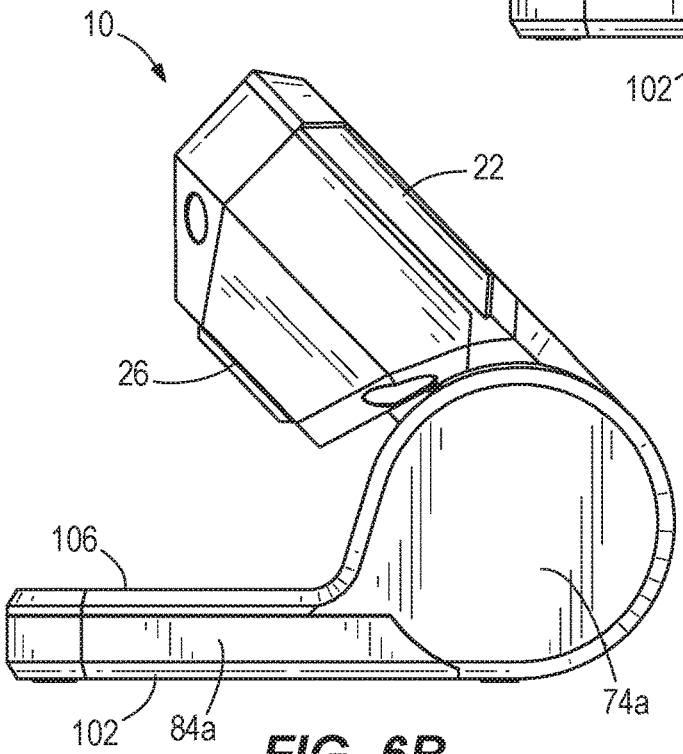
FIG. 6B is a side view of the lighting device of FIG. 1 in a partially extended position.
Figure 6C:
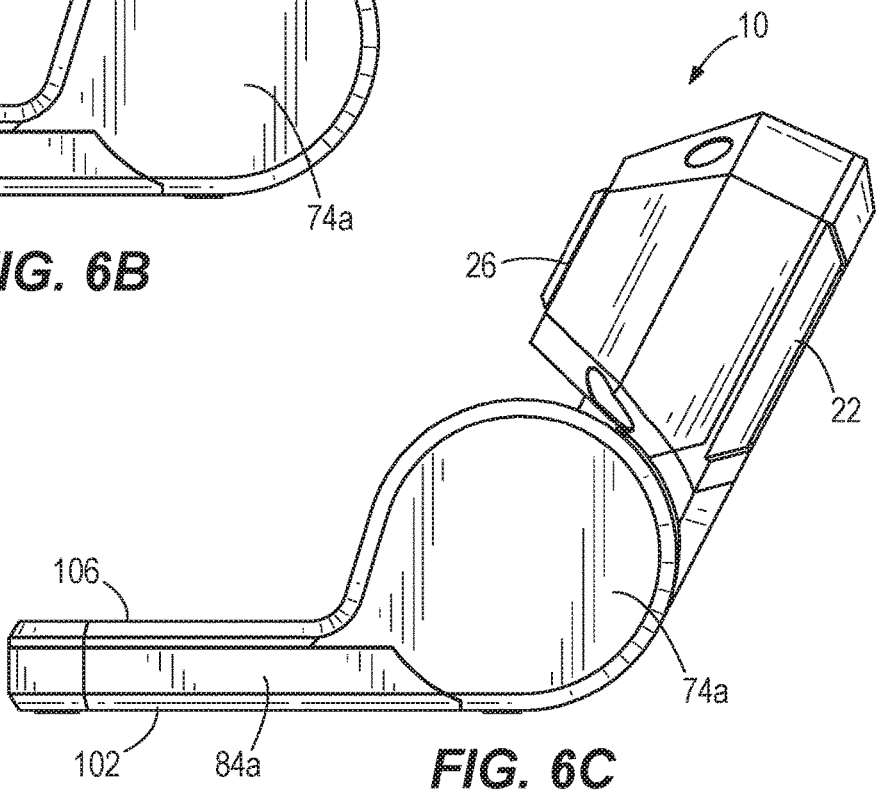
FIG. 6C is a side view of the lighting device of FIG. 1 in another partially extended position.
Figure 6D:
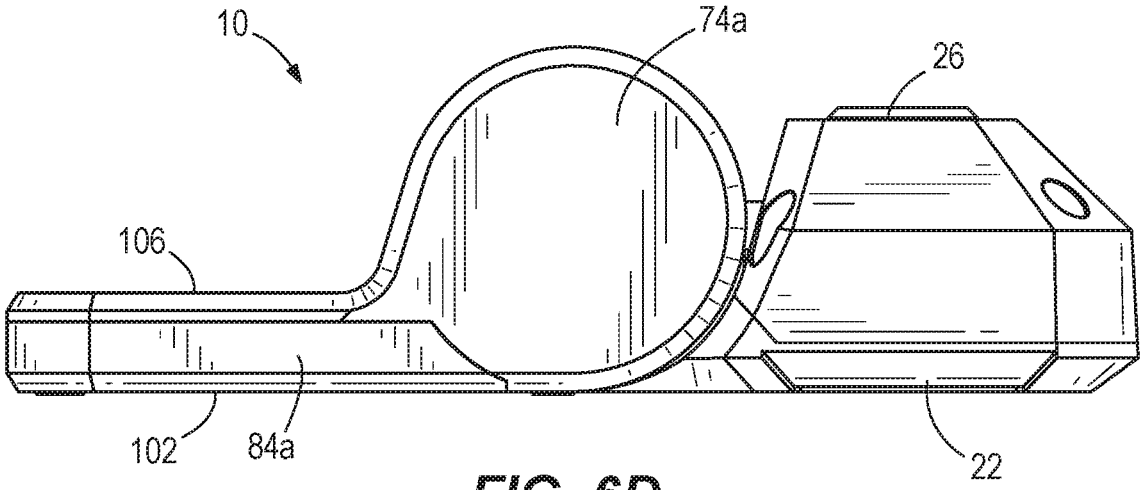
FIG. 6D is a side view of the lighting device of FIG. 1 in a fully extended position.
Figure 6E:
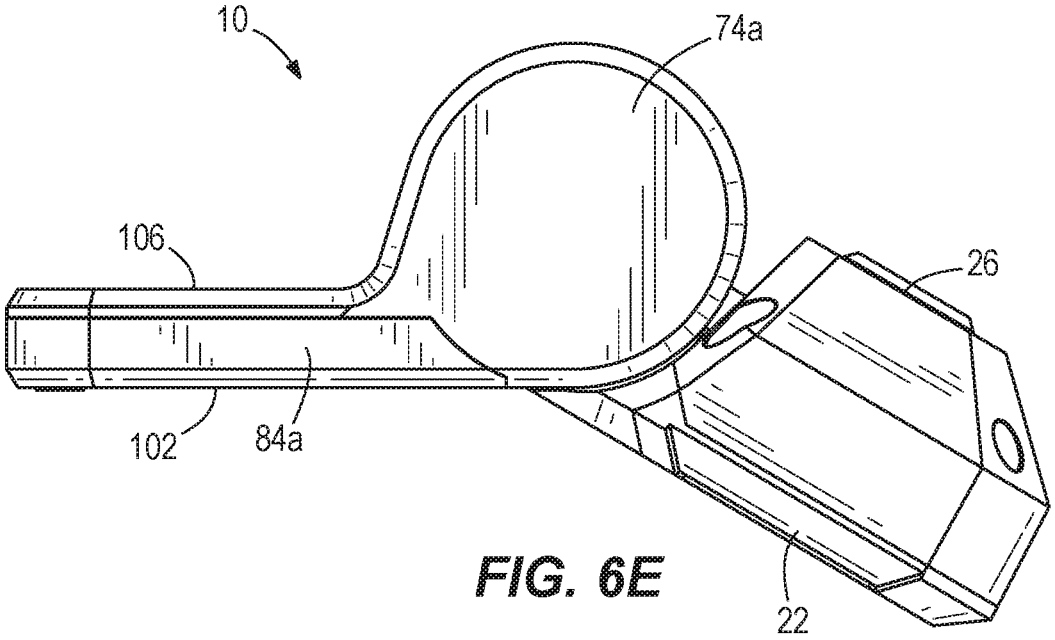
FIG. 6E is a side view of the lighting device of FIG. 1 in an over-extended position.

When in the collapsed position (FIG. 6A) or any partially extended position (see, e.g., FIGS. 6B and 6C), the user may position the first side 102 of the base 18 directly on the support surface to direct light away from the base 18. Alternatively, the light device 10 may be positioned on the first boss 74*a* and first edge 84*a* of the base 18, or the second boss 74*b* and the second edge 84*b* of the base 18, orienting the light device 10 in a substantially vertical orientation. The light device 10 may also be supported on the first boss 74*a* and first edge 84*a*, or the second boss 74*b* and the second edge 84*b*, when in the fully extended position (FIG. 6D) and when in the overextended position (FIG. 6E).

In some embodiments, the lighting device 10 can have a maximum length L (measured between the light housing 14 and the base 18 in a direction perpendicular to the pivot axis 78) that is less than 7 inches, a maximum width W (measured between the battery cover 66 and the first boss 74*a* in a direction parallel to the pivot axis 78) that is less than 5 inches, and a maximum height H (measured between the first face 22 and the second face 26 of the light housing 14 in a direction perpendicular to the pivot axis 78) that is less than 4 inches. In the illustrated embodiment, the length L of the light device 10 is approximately 4.3 inches, the height H is approximately 1.3 inches, and the width W is approximately 4.3 inches.

The illustrated light device 10 is thereby relatively compact and lightweight, but high-powered and long-lasting light. For example, a ratio of maximum light output (e.g., while in the high mode) in lumens to volume of the light device 10 in cubic inches is between 20:1 and 25:1. Further, a ratio of maximum light output in lumens to mass of the light device 10 in grams (with the battery 58) is between 2:1 and 3:1.

Although the invention has been described in detail with reference to certain preferred embodiments, variations and modifications exist within the scope and spirit of one or more independent aspects of the invention as described. Various features and advantages of the invention are set forth in the following claims.

What is claimed is:

1. A lighting device comprising:

a light housing including a first face and a second face opposite the first face;

a light source coupled to the light housing;

a battery compartment coupled to the light housing and configured to house a battery, the battery compartment defining a central longitudinal axis along which the battery is insertable; and a base coupled to the light housing, the base including a first side and a second side opposite the first side, the first side configured to rest on a support surface, wherein the light housing and the battery compartment are rotatable together relative to the base about the central longitudinal axis from a first position, where the second face of the light housing is adjacent the second side of the base, to a second position, where the second face of the light housing is spaced apart from the second side of the base; and a control panel positioned on the second face and electrically coupled to the light source and operable to control the light source.

2. The lighting device of claim 1, wherein when the light housing and the battery compartment are in the second position, the first face is offset and coplanar with the first side.

3. The lighting device of claim 2, wherein the light housing is rotatable relative to the base to a plurality of intermediate positions between the first position and the second position.

4. The lighting device of claim 2, wherein light source is configured to emit light in a direction away from the base while in the first position.

5. The lighting device of claim 1, wherein the light housing is rotatable relative to the base to a third position wherein the light housing is extended past the second position and the front face is orientated at an oblique angle relative to the first side.

6. The lighting device of claim 1, wherein the base includes a first boss and a second boss spaced apart from the first boss, wherein the first and second bosses are pivotably coupled to the battery compartment, and wherein the first and second bosses are configured to rest on a support surface to support the lighting device.

7. The lighting device of claim 1, wherein the base is configured to support the light housing on a support surface at a plurality of angles.

8. The lighting device of claim 1, wherein the base includes a carabineer having a first arm extending from the light housing, a second arm extending from the light housing and spaced apart from the first arm, and a gate extending between the first arm and the second arm.

9. The lighting device of claim 8, wherein the gate includes a detent formed on an inner surface of the gate, wherein the detent is configured to hang from a support structure.

10. The lighting device of claim 8, wherein the gate is composed of a metal material, and wherein the gate is configured to magnetically couple to a metallic surface.

11. The lighting device of claim 8, wherein the first arm and the second arm include magnetic plates configured to magnetically couple the base to a metallic surface.

12. The lighting device of claim 1, wherein the light housing and the battery compartment are rotatable together relative to the base through an angle of 210 degrees.

13. The lighting device of claim 1, wherein the control panel includes a USB charging port.

14. The lighting device of claim 1, wherein a ratio of maximum light output emitted by the light source in lumens to a volume of the lighting device in cubic inches is between 20:1 and 25:1.

15. The lighting device of claim 1, wherein a ratio of maximum light output emitted by the light source in lumens to a mass of the lighting device in grams is between 2:1 and 3:1.

16. A lighting device comprising:

a light housing including a first face and a second face opposite the first face;

a light source coupled to the light housing and configured to emit light from the first face; and a base rotatably coupled to the light housing, the base including a first side and a second side opposite the first side, the first side configured to rest on a support surface to support the lighting device;

wherein the light housing is rotatable relative to the base from a first position, where the second face of the light housing is adjacent the second side of the base, to a second position, where the first face of the light housing is offset and coplanar with the first side of the base.

17. The lighting device of claim 16, wherein the light source is configured to emit light in a direction away from the base while in the first position.

18. A lighting device comprising:

a light housing;

a light source coupled to the light housing; and a base rotatably coupled to the light housing, the base configured to support the light housing on a support surface at a plurality of angles, the base including a carabineer having a first arm extending from the light housing, a second arm extending from the light housing and spaced apart from the first arm, and a gate extending between the first arm and the second arm.

19. The lighting device of claim 18, further comprising a control panel supported by the light housing, wherein the control panel is electrically coupled to the light source and operable to control the light source.

* * * * *